US012576317B2

(12) United States Patent
Breedlove

(10) Patent No.: US 12,576,317 B2
(45) Date of Patent: Mar. 17, 2026

(54) BUNKER RAKE HOLDER

(71) Applicant: Richard Breedlove, West Baden Springs, IN (US)

(72) Inventor: Richard Breedlove, West Baden Springs, IN (US)

( * ) Notice: Subject to any disclaimer, the term of this patent is extended or adjusted under 35 U.S.C. 154(b) by 128 days.

(21) Appl. No.: 18/604,241

(22) Filed: Mar. 13, 2024

(65) Prior Publication Data

US 2025/0229146 A1 Jul. 17, 2025

Related U.S. Application Data

(60) Provisional application No. 63/620,631, filed on Jan. 12, 2024.

(51) Int. Cl.
*B60R 9/08* (2006.01)
*A63B 57/20* (2015.01)
*A63B 57/50* (2015.01)

(52) U.S. Cl.
CPC ..... *A63B 57/20* (2015.10); *A63B 57/50* (2015.10)

(58) Field of Classification Search
CPC ..... B60R 2011/0075; B60R 9/08; B60R 2011/004; B60R 9/00; A63B 57/20; A63B 57/50
USPC ..... 224/274, 922
See application file for complete search history.

(56) References Cited

U.S. PATENT DOCUMENTS

| | | | | |
|---|---|---|---|---|
| 1,670,962 | A * | 5/1928 | Hall | B60R 7/08 135/34.2 |
| 2,749,645 | A * | 6/1956 | Mckern | A01K 97/08 206/315.11 |
| 4,132,381 | A * | 1/1979 | McClellan | F16B 2/22 224/406 |
| 5,088,600 | A * | 2/1992 | Kopp, Jr. | A63B 60/62 206/315.6 |
| 5,437,320 | A * | 8/1995 | Sung | A63B 60/62 150/160 |
| 11,291,894 | B2 * | 4/2022 | Payne | A63B 55/10 |
| 11,370,363 | B2 * | 6/2022 | McFadden | B60R 9/08 |
| 11,751,684 | B2 * | 9/2023 | Bedard | A01K 97/10 211/70.8 |
| 2009/0159625 | A1 * | 6/2009 | Pearce | B63B 25/002 224/406 |

* cited by examiner

*Primary Examiner* — Adam J Waggenspack

(57) ABSTRACT

A bunker rake holder includes a tubular body, an end cap, a tubular connector, a front clamp, and a rear clamp. The end cap and the tubular connector are oppositely positioned of each other about the tubular body. The end cap and the tubular connector are concentrically positioned to the tubular body. The end cap is terminally connected around the tubular body and encloses one end of the tubular body. The tubular connector is terminally connected around the tubular body and strengthens the opposite end of the tubular body. The front clamp is positioned adjacent to the tubular connector. The rear clamp is positioned adjacent to the end cap. The front clamp and the rear clamp are adhered offset of each other and onto the roof of the golf cart thus attaching the tubular body within the front clamp and the rear clamp.

15 Claims, 7 Drawing Sheets

BUNKER RAKE HOLDER

The current application claims a priority to the U.S. Provisional Patent application Ser. No. 63/620,631 filed on Jan. 12, 2024.

FIELD OF THE INVENTION

The present invention relates generally to golf equipment. More specifically, the present invention is an apparatus that mounts onto the roof of the golf cart and securely holds a golf course bunker rake.

BACKGROUND OF THE INVENTION

A golf course bunker rake is used to maintain bunkers by packing down the vertical sides of a bunker and/or roughing up the bottom of the bunker without leaving large grooves in the sand. Transporting the rakes to the bunkers on the golf course can be a pain. Handheld bunker rakes are configured similar to traditional garden rakes with minor differences such as lighter material, wider coverage, and two-sided functionality. The bunker rakes are generally placed near the edge of the golf bunkers where they are least likely to affect the movement of the ball. However, some caddies prefer to carry their own bunker rake so that the golfer can optimize their game experience. Due to the length and the shape of the bunker rake, it is difficult to store and transport the bunker rake within the golf cart and often times the golf cart has to be upgraded with expensive accessories to store the bunker rake.

Therefore, an objective of the present invention addresses this issue by providing users with an apparatus that mounts onto the roof of the golf cart to securely hold the bunker rake. The present invention is an elongated storage compartment and adhered onto the roof of the golf cart without compromising the structural integrity or the functionality of the roof. Resultantly, the present invention is able to provide an inexpensive and functional storage apparatus to store and transport the bunker rake within the golf cart.

DETAILED DESCRIPTION OF THE INVENTION

All illustrations of the drawings are for the purpose of describing selected versions of the present invention and are not intended to limit the scope of the present invention.

Figure 1:
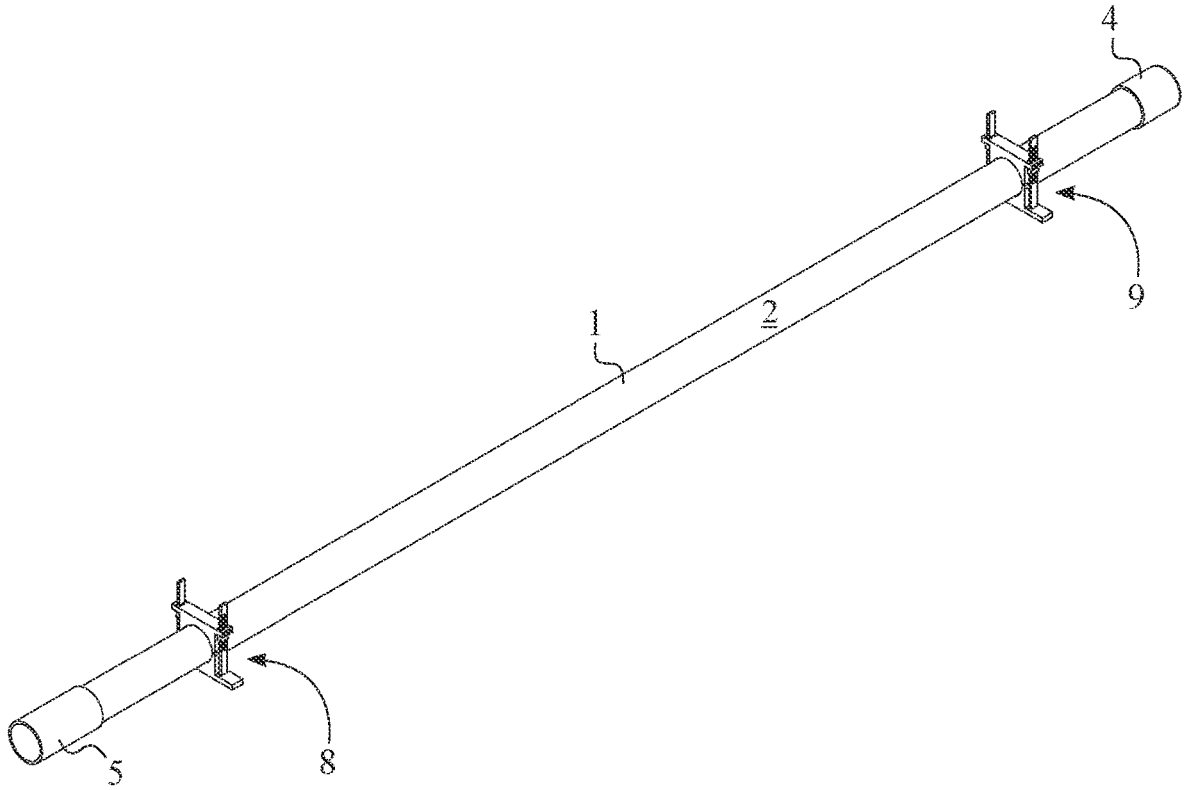
FIG. 1 is a top perspective view of the present invention.
Figure 2:
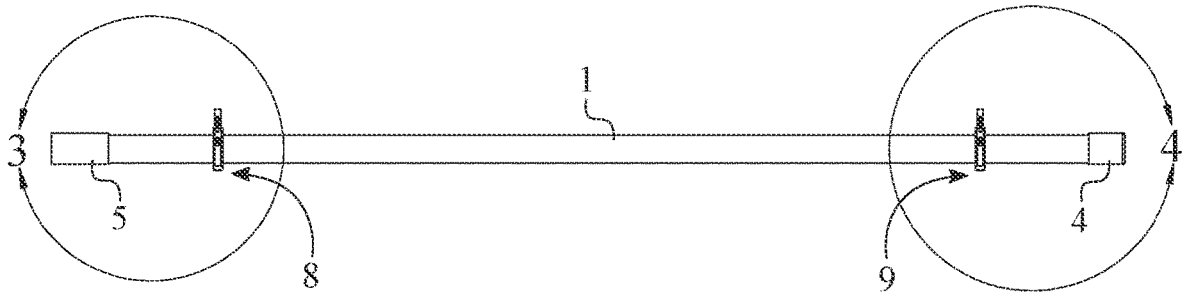
FIG. 2 is a side view of the present invention.

The present invention is an apparatus that mounts onto the roof of the golf cart and securely holds a golf course bunker rake. Due to the placement of the present invention, the head of the bunker rake drops into the existing rain groove/drip edge of the golf cart as the handle of the bunker rake is placed within the present invention. As shown in FIG. 1 and FIG. 2, the present invention comprises a tubular body 1, an end cap 4, a tubular connector 5, a front clamp 8, and a rear clamp 9.

Figure 3:
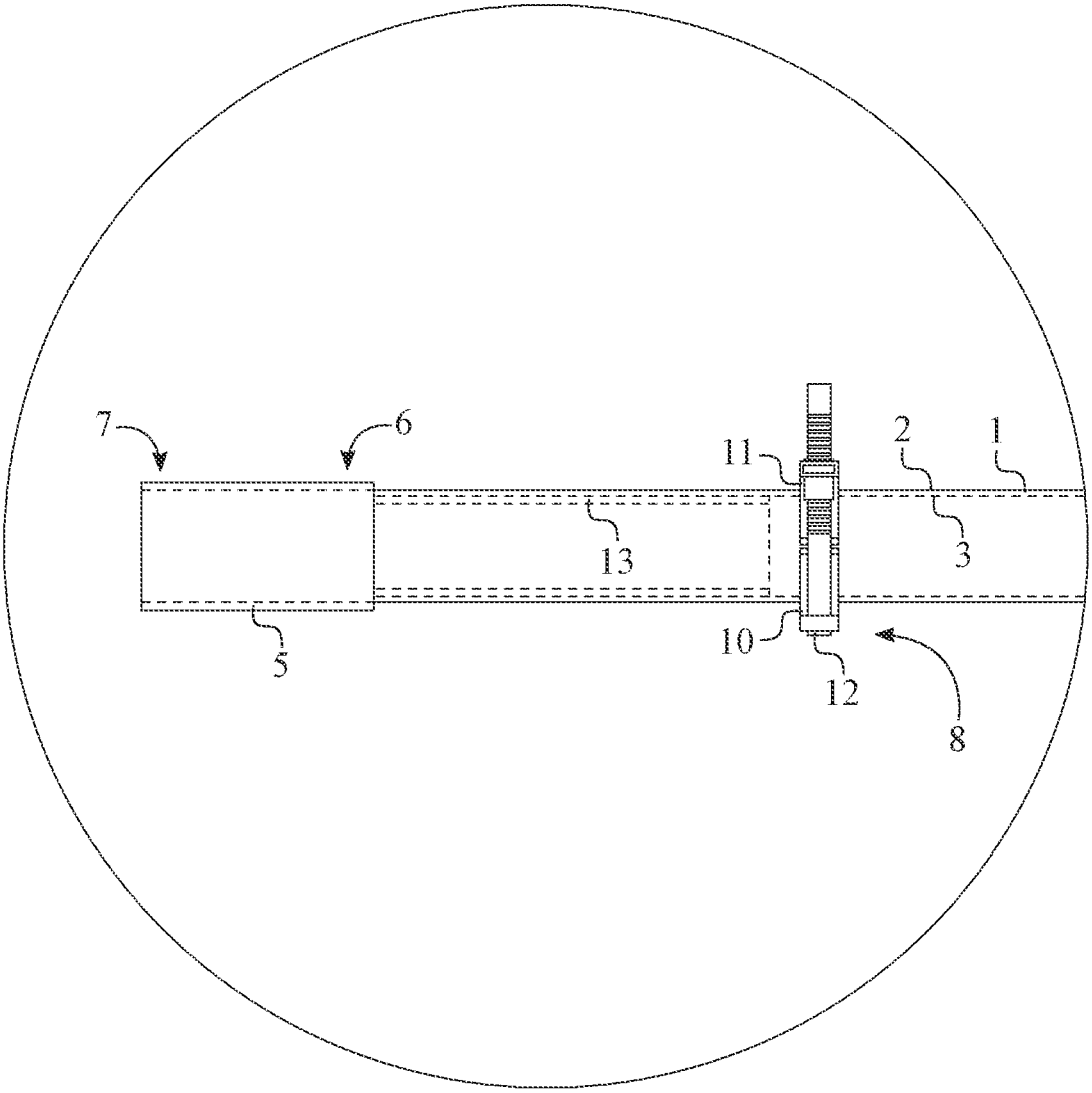
FIG. 3 is a detailed view taken about circle 3 in FIG. 2.
Figure 4:
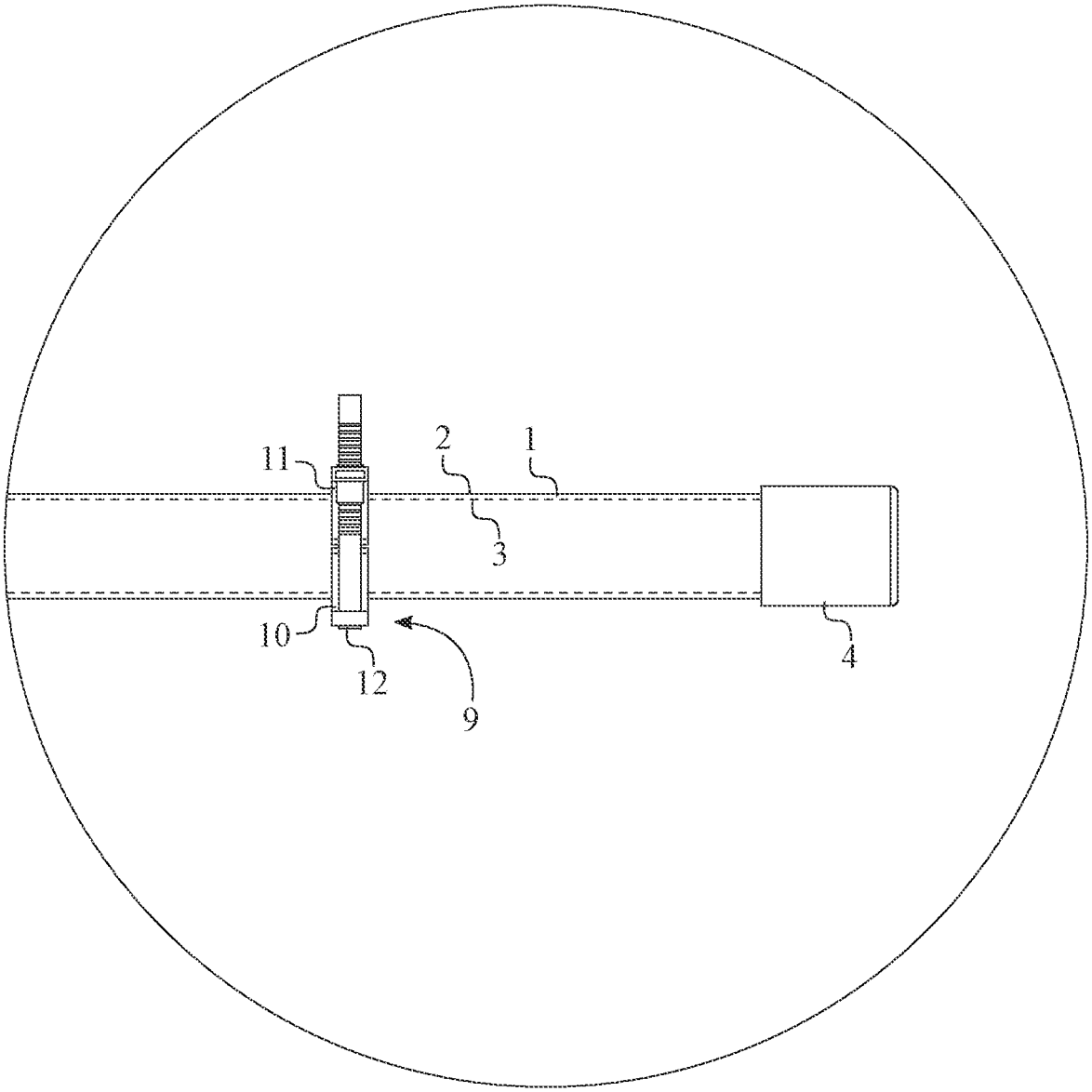
FIG. 4 is a detailed view taken about circle 4 in FIG. 2.
Figure 5:
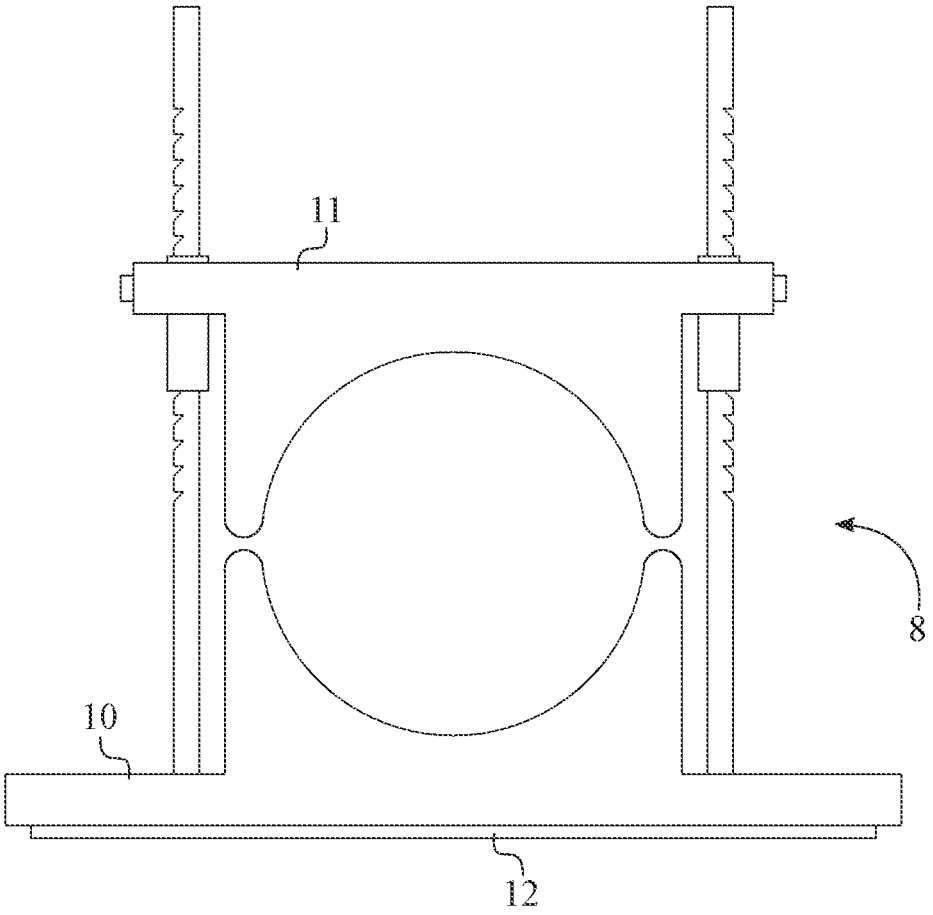
FIG. 5 is a front view of the front clamp of the present invention.
Figure 6:
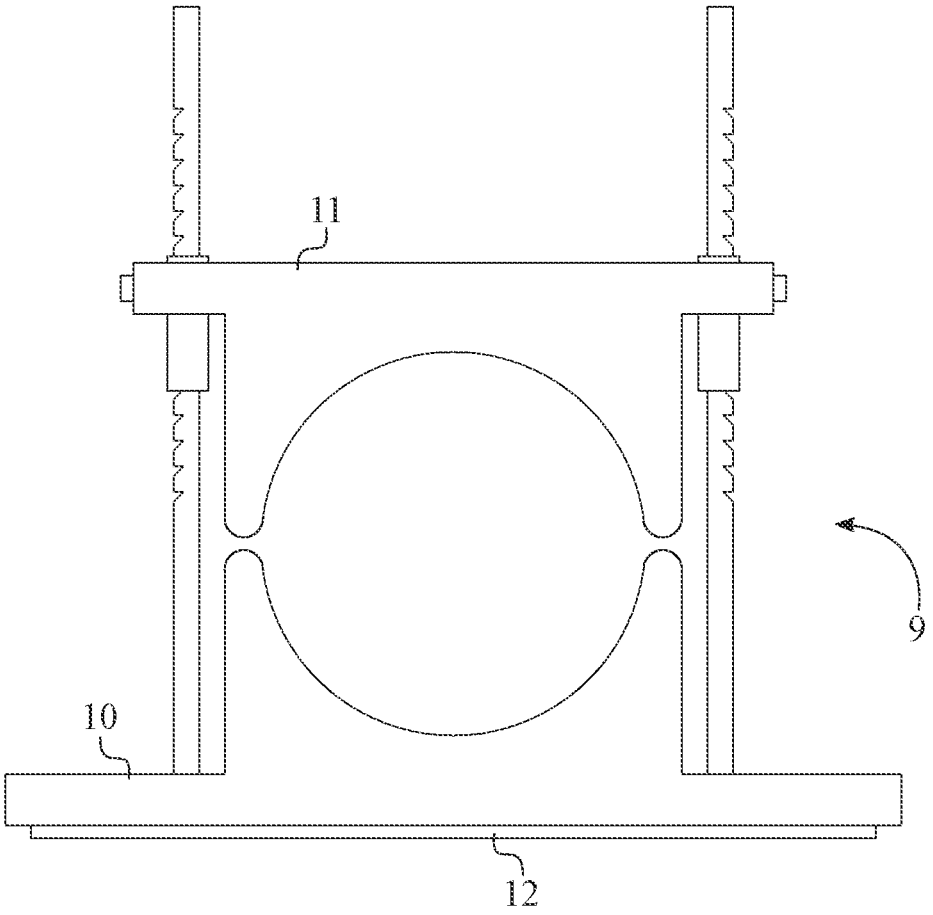
FIG. 6 is a front view of the rear clamp of the present invention.

In reference to the general configuration of the present invention, as shown in FIGS. 2-4, the end cap 4 and the tubular connector 5 are concentrically and axially positioned to the tubular body 1 thus delineating the overall shape. More specifically, the tubular body 1 is an elongated linear body so that the handle of the bunker rake can be positioned within. The end cap 4 and the tubular connector 5 are oppositely positioned of each other about the tubular body 1 to further enhance the terminal edges of the tubular body 1. More specifically, the end cap 4 is terminally connected around the tubular body 1 thus enclosing one end of the tubular body 1. The tubular connector 5 is terminally connected around the tubular body 1 and functions as a structural opening to receive the handle of the bunker rake. The front clamp 8 is positioned adjacent to the tubular connector 5 and functions as the first attachment between the tubular body 1 to the roof of the golf cart. The rear clamp 9 is positioned adjacent to the end cap 4 and functions as the second attachment between the tubular body 1 and the roof of the golf cart. In other words, the front clamp 8 and the rear clamp 9 are mounted offset of each other to the roof of the golf cart so that the tubular body 1 can be attached to the front clamp 8 and the rear clamp 9.

In tubular connector 5 strengthens the tubular body 1 to withstand the insertion and the removal of the bunker rake. In reference to FIG. 3 and FIG. 4, the tubular connector 5 may comprise a fixed end 6 and a free end 7. The end cap 4 is terminally connected to an outer surface 2 of the tubular body 1 and encloses the tubular body 1 to prevent entry of dust, debris, and other environmental elements. The fixed end 6 is adjacently positioned to the free end 7 thus delineating the general shape of the tubular connector 5. When the tubular connector 5 is connected to the tubular body 1, the fixed end 6 is terminally connected to the outer surface 2 of the tubular body 1 as the free end 7 is positioned offset to the tubular body 1. As a result, the tubular connector 5 and the end cap 4 are able to further strengthen the tubular body 1 and enhance the functionality of the present invention.

The front clamp 8 and the rear clamp 9 function as the two attachment brackets between the tubular body 1 and the roof of the golf cart. As shown in FIGS. 3-6, the front clamp 8 and the rear clamp 9 may each comprise a first interlocking body 10, a second interlocking body 11, and an adhesive layer 12. The adhesive layer 12 is superimposed onto the first interlocking body 10 so that the first interlocking body 10 can be adhered onto the roof of the golf cart. Preferably, the present invention utilizes all-weather and UV-resistance adhesive strips so that the attachment between the first interlocking body 10 and the roof of the golf cart can be durable. Furthermore, the adhesive layer 12 is able to secure the first interlocking body 10 to the roof of the golf cart without having damage, drill or structurally modifying the roof of the golf cart. The second interlocking body 11 is adjustably attached to the first interlocking body 10 as the adhesive layer 12 and the second interlocking body 11 are oppositely positioned of each other about the first interlocking body 10. For example, when the tubular body 1 is placed within the front clamp 8 and the rear clamp 9, the first interlocking body 10 and the second interlocking body 11 are positioned around the outer surface 2 of the tubular body 1 in such a way that the tubular body 1 is adjustably crimped in between the first interlocking body 10 and the second interlocking body 11. It is also understood that the tubular body 1 can be secured to roof of the golf cart with any other type of industry standard clamps other than the first clamp and the second clamp without deviating from the scope of the functionality.

As shown in FIG. 3, the present invention may further comprise a substrate layer 13 so that the bunker rake can be secured within the tubular body 1. The substrate layer 13 is superimposed onto an inner surface 3 of the tubular body 1 and positioned adjacent to the tubular connector 5. In reference to the preferred embodiment of the present invention, the substrate layer 13 is partially extended into the tubular body 1. It is understood that some embodiments of the present invention, the substrate layer 13 can fully extend over the inner surface 3 of the present invention. In some embodiments, the substrate layer 13 can be configured as a noise reduction layer so that impact noise between the bunker rake and the tubular body 1 can be minimized. In some embodiments, the substrate layer 13 can be configured as a slip resistance layer to prevent unintentional dislodging of the bunker rake from the tubular body 1. In some embodiments, the substrate layer 13 can be configured as a noise reduction and slip resistance layer so that impact noise between the bunker rake and the tubular body 1 can be minimized, and the bunker rake can be securely positioned within the tubular body 1.

The tubular body 1 of the present invention can be painted or customized according to user preferences. The tubular body 1 can also be utilized to display logos and advertising material. Due to the elongated shape of the tubular body 1, the outer surface 2 of the tubular body 1 provides a prime advertising surface area that is visible clearly visible from the left or right side of the golf cart.

Figure 7:
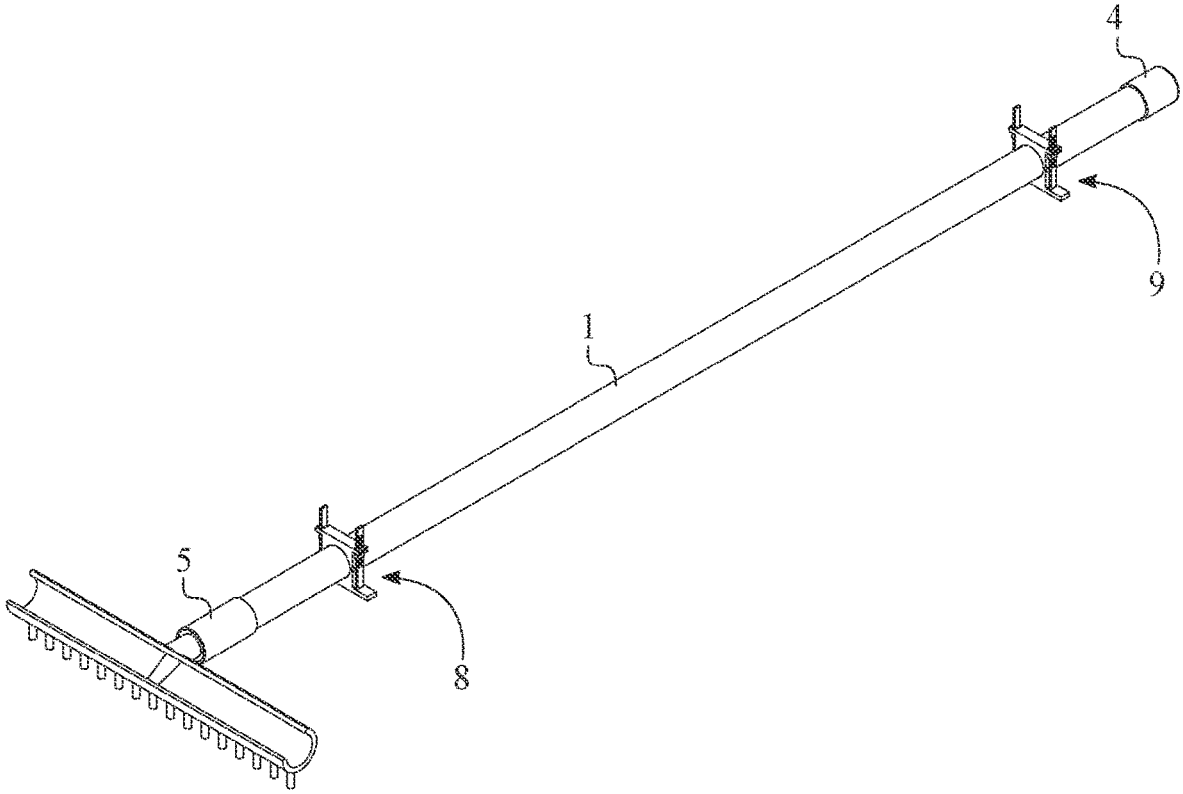
FIG. 7 is a top perspective view of the present invention, wherein a bunker rake is shown within.

As shown in FIG. 7, when the bunker rake is inserted into the present invention, the user can insert the handle of the bunker rake into the tubular body 1 via the tubular connector 5. Then, the handle of the bunker rake is positioned and retained within the tubular body 1 due to the elongated linear body and the substrate layer 13. Simultaneously, the head of the bunker rake is positioned within the existing rain groove/drip edge of the golf cart thus further securing the bunker rake within the tubular body 1. When the bunker rake needs to be removed from the present invention, the user can lift up the head of the bunker rake and pull out the handle of the bunker rake from the tubular body 1.

Although the invention has been explained in relation to its preferred embodiment, it is to be understood that many other possible modifications and variations can be made without departing from the spirit and scope of the invention as hereinafter claimed.

What is claimed is:

1. An apparatus mounted onto a golf-cart roof to hold a golf-course bunker rake comprising:
- a tubular body;
- an end cap;
- a tubular connector;
- a front clamp;
- a rear clamp;
- the front clamp and the rear clamp each comprising a first interlocking body, a second interlocking body, and an adhesive layer;
- the end cap and the tubular connector being oppositely positioned of each other about the tubular body;
- the end cap and the tubular connector being concentrically positioned to the tubular body;
- the end cap being terminally connected around the tubular body;
- the tubular connector being terminally connected around the tubular body;
- the front clamp being positioned adjacent to the tubular connector;
- the rear clamp being positioned adjacent to the end cap;
- the tubular body being attached to the front clamp and the rear clamp;
- the adhesive layer being superimposed onto the first interlocking body;
- the second interlocking body being adjustably attached to the first interlocking body;
- the adhesive layer and the second interlocking body being oppositely positioned of each other about the first interlocking body;
- the first interlocking body and the second interlocking body positioned around an outer surface of the tubular body; and
- the tubular body being adjustably crimped in between the first interlocking body and the second interlocking body.

2. The apparatus mounted onto a golf-cart roof to hold a golf-course bunker rake as claimed in claim 1, wherein the tubular body is an elongated linear body.

3. The apparatus mounted onto a golf-cart roof to hold a golf-course bunker rake as claimed in claim 1 comprising:
- the tubular connector comprising a fixed end and a free end;
- the end cap being terminally connected to an outer surface of the tubular body;
- the fixed end being adjacently positioned to the free end;
- the fixed end being terminally connected to the outer surface of the tubular body; and
- the free end extending beyond the tubular body.

4. The apparatus mounted onto a golf-cart roof to hold a golf-course bunker rake as claimed in claim 1 comprising:
- a substrate layer;
- the substrate layer being superimposed onto an inner surface of the tubular body; and
- the substrate layer being positioned adjacent to the tubular connector.

5. The apparatus mounted onto a golf-cart roof to hold a golf-course bunker rake as claimed in claim 4, wherein the substrate layer is configured as a noise reduction layer.

6. The apparatus mounted onto a golf-cart roof to hold a golf-course bunker rake as claimed in claim 4, wherein the substrate layer is configured as a slip resistance layer.

7. An apparatus mounted onto a golf-cart roof to hold a golf-course bunker rake comprising:
- a tubular body;
- an end cap;
- a tubular connector;
- a front clamp;
- a rear clamp;
- a substrate layer;
- the front clamp and the rear clamp each comprising a first interlocking body, a second interlocking body, and an adhesive layer;
- the end cap and the tubular connector being oppositely positioned of each other about the tubular body;
- the end cap and the tubular connector being concentrically positioned to the tubular body;
- the end cap being terminally connected around the tubular body;
- the tubular connector being terminally connected around the tubular body;
- the front clamp being positioned adjacent to the tubular connector;

the rear clamp being positioned adjacent to the end cap;

the tubular body being attached to the front clamp and the rear clamp;

the substrate layer being superimposed onto an inner surface of the tubular body;

the substrate layer being positioned adjacent to the tubular connector;

the adhesive layer being superimposed onto the first interlocking body;

the second interlocking body being adjustably attached to the first interlocking body;

the adhesive layer and the second interlocking body being oppositely positioned of each other about the first interlocking body;

the first interlocking body and the second interlocking body positioned around an outer surface of the tubular body; and the tubular body being adjustably crimped in between the first interlocking body and the second interlocking body.

8. The apparatus mounted onto a golf-cart roof to hold a golf-course bunker rake as claimed in claim 7, wherein the tubular body is an elongated linear body.

9. The apparatus mounted onto a golf-cart roof to hold a golf-course bunker rake as claimed in claim 7 comprising:

the tubular connector comprising a fixed end and a free end;

the end cap being terminally connected to an outer surface of the tubular body;

the fixed end being adjacently positioned to the free end;

the fixed end being terminally connected to the outer surface of the tubular body; and the free end extending beyond the tubular body.

10. The apparatus mounted onto a golf-cart roof to hold a golf-course bunker rake as claimed in claim 7, wherein the substrate layer is configured as a noise reduction layer.

11. The apparatus mounted onto a golf-cart roof to hold a golf-course bunker rake as claimed in claim 7, wherein the substrate layer is configured as a slip resistance layer.

12. An apparatus mounted onto a golf-cart roof to hold a golf-course bunker rake comprising:

a tubular body;

an end cap;

a tubular connector;

a front clamp;

a rear clamp;

a substrate layer;

the front clamp and the rear clamp each comprising a first interlocking body, a second interlocking body, and an adhesive layer;

the tubular body being an elongated linear body;

the end cap and the tubular connector being oppositely positioned of each other about the tubular body;

the end cap and the tubular connector being concentrically positioned to the tubular body;

the end cap being terminally connected around the tubular body;

the tubular connector being terminally connected around the tubular body;

the front clamp being positioned adjacent to the tubular connector;

the rear clamp being positioned adjacent to the end cap;

the tubular body being attached to the front clamp and the rear clamp;

the substrate layer being superimposed onto an inner surface of the tubular body;

the substrate layer being positioned adjacent to the tubular connector;

the adhesive layer being superimposed onto the first interlocking body;

the second interlocking body being adjustably attached to the first interlocking body;

the adhesive layer and the second interlocking body being oppositely positioned of each other about the first interlocking body;

the first interlocking body and the second interlocking body positioned around an outer surface of the tubular body; and the tubular body being adjustably crimped in between the first interlocking body and the second interlocking body.

13. The apparatus mounted onto a golf-cart roof to hold a golf-course bunker rake as claimed in claim 12 comprising:

the tubular connector comprising a fixed end and a free end;

the end cap being terminally connected to an outer surface of the tubular body;

the fixed end being adjacently positioned to the free end;

the fixed end being terminally connected to the outer surface of the tubular body; and the free end extending beyond the tubular body.

14. The apparatus mounted onto a golf-cart roof to hold a golf-course bunker rake as claimed in claim 12, wherein the substrate layer is configured as a noise reduction layer.

15. The apparatus mounted onto a golf-cart roof to hold a golf-course bunker rake as claimed in claim 12, wherein the substrate layer is configured as a slip resistance layer.

* * * * *